US007123147B2

(12) United States Patent
Engel

(10) Patent No.: US 7,123,147 B2
(45) Date of Patent: Oct. 17, 2006

(54) ELECTRONIC MAILBOX WITH ELECTRONICALLY PROGRAMMED ACCESS DOOR TO REMOVE MAIL, WITH SEPARATE MAIL DELIVERY SLOT CONFIGURED TO PREVENT ACCESS TO MAIL BOX, AND WITH AUXILIARY BACKUP POWER SYSTEM

(76) Inventor: Raymond C. Engel, 2351 Tenaya Dr., Modesto, CA (US) 95354

( * ) Notice: Subject to any disclaimer, the term of this patent is extended or adjusted under 35 U.S.C. 154(b) by 0 days.

(21) Appl. No.: 10/841,060

(22) Filed: May 7, 2004

(65) Prior Publication Data

US 2005/0247771 A1 Nov. 10, 2005

(51) Int. Cl.
*G08B 13/14* (2006.01)

(52) U.S. Cl. ..... 340/569; 232/35; 232/36; 340/545.6

(58) Field of Classification Search ..... 340/569, 340/3.8, 5.2, 693.2, 690
See application file for complete search history.

(56) References Cited

U.S. PATENT DOCUMENTS

| | | | | |
|---|---|---|---|---|
| 5,023,595 | A * | 6/1991 | Bennett | 340/569 |
| 5,475,378 | A * | 12/1995 | Kaarsoo et al. | 340/5.6 |
| 5,917,411 | A * | 6/1999 | Baggarly | 340/569 |
| 6,119,622 | A * | 9/2000 | Banerjea | 116/202 |
| 2003/0231112 | A1 * | 12/2003 | Raju | 340/569 |

* cited by examiner

*Primary Examiner*—Jeffery Hofsass
*Assistant Examiner*—Hoi C. Lau
(74) *Attorney, Agent, or Firm*—Tod R. Nissle, P.C.

(57) ABSTRACT

An improved electronic mailbox increases the difficulty of stealing mail from the mailbox. The mailbox includes an electronically programmed access door, a mail slot shaped to prevent access to the mail box, and an auxiliary backup power system.

12 Claims, 3 Drawing Sheets

FIG. 3
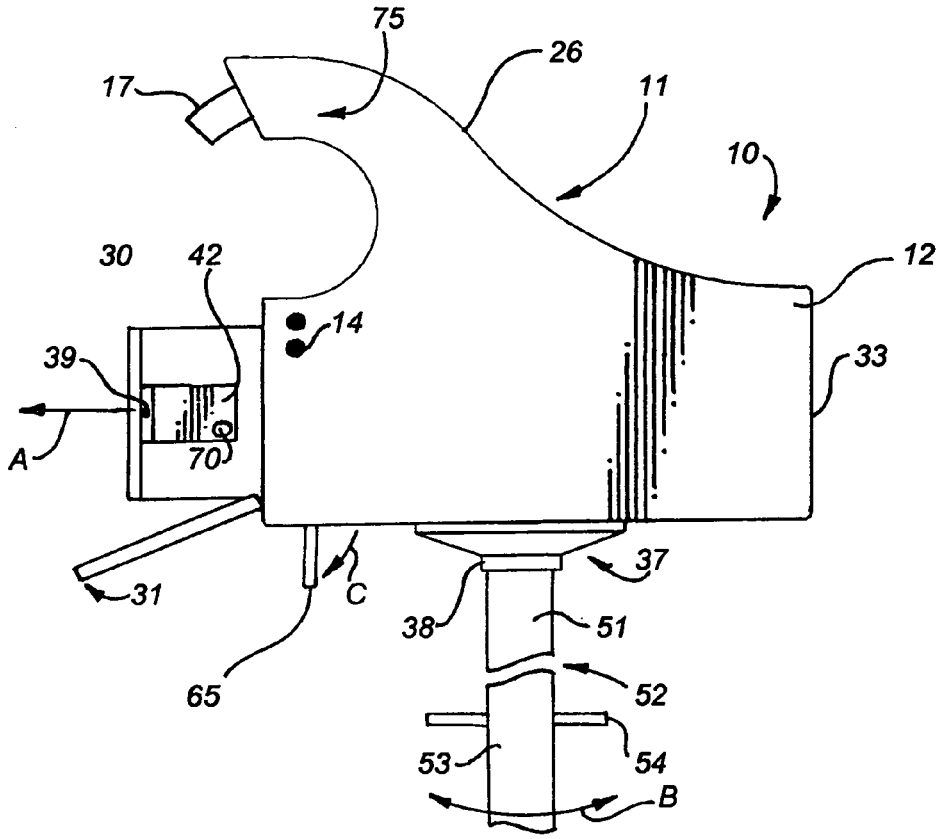
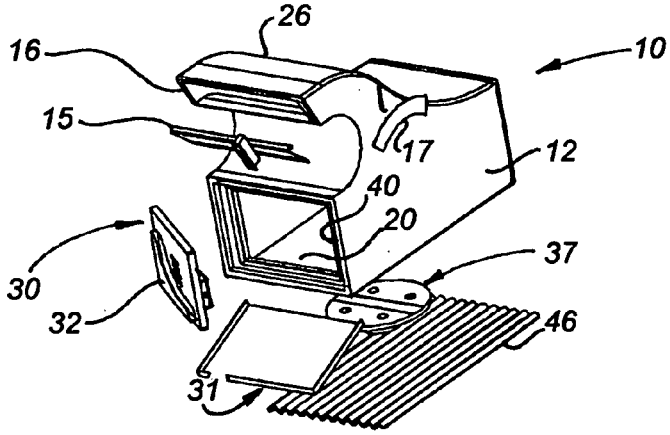
FIG. 4

ELECTRONIC MAILBOX WITH ELECTRONICALLY PROGRAMMED ACCESS DOOR TO REMOVE MAIL, WITH SEPARATE MAIL DELIVERY SLOT CONFIGURED TO PREVENT ACCESS TO MAIL BOX, AND WITH AUXILIARY BACKUP POWER SYSTEM

This invention pertains to mailboxes.

More particularly, the invention pertains to a mailbox that reduces the risk that mail delivered to the mailbox will be stolen or damaged.

The theft of mail from mailboxes is an increasing problem in today's society, particularly because an increasing proportion of society appears to evidence little, if any, respect for the property of others, appears to embrace the concept that each individual has the "right" to do whatever gratifies that individual, and appears to believe that it is of minimal importance and is "out of style" and "old fashioned" to employ normal moral standards of truth, honesty, hard work, and respect for others. Further, such individuals often justify theft on the basis that the owner of the mailbox "deserves" to be a victim of theft because the owner did little to protect his or her property. Most conventional mailboxes are ready targets for such dishonest individuals because they are easily accessed and in many instances are unattended for long periods of time.

Accordingly, it would be highly desirable to provide an improved mailbox that would make it difficult for an unauthorized person to steal mail from the mailbox.

Therefore, it is a principal object of the invention to provide an improved mailbox.

A further object of the invention is to provide an improved mailbox that would require a dishonest person to expend more effort than expected in attempting to steal mail from the mailbox, that would tend to frustrate the dishonest person, that would be less susceptible to being damaged in the event the dishonest person loses his temper in attempting to access the mailbox and attempts to damage the mailbox, and that would tend to cause the dishonest person to end his attempts to steal from the mailbox and to move on to another potential target.

These and other, further and more specific objects and advantages of the invention will be apparent to those skilled in the art from the following detailed description thereof, taken in conjunction with the drawings, in which:

FIG. 3 is a side view illustrating the mailbox of FIG. 1 on a post utilized to secure the mailbox in the ground;

FIG. 4 is an exploded view illustrating the mailbox of FIG. 1; and,

Briefly, in accordance with the invention, I provide an improved mailbox. The mailbox includes a housing having an interior; a slot in the housing for inserting mail through the slot into the interior of the housing; a doorway in the housing to access the interior; and, a door mounted in the doorway to access the interior and including a lock. The door moves between at least two operative positions, a first operative position closing the doorway and preventing access to the interior, and a second operative position opening the doorway and permitting access to the interior. The mailbox also includes a programmable electronic keypad operatively associated with the lock to move the lock between at least two operative positions, a closed position to secure the door in the first operative position, and an open position to permit the door to move from the first operative position to the second operative position. The mailbox also includes a primary power source to provide electric power to operate the keypad; and, an access port to connect an auxiliary power source to the keypad in the event the primary power source fails.

Figure 1:
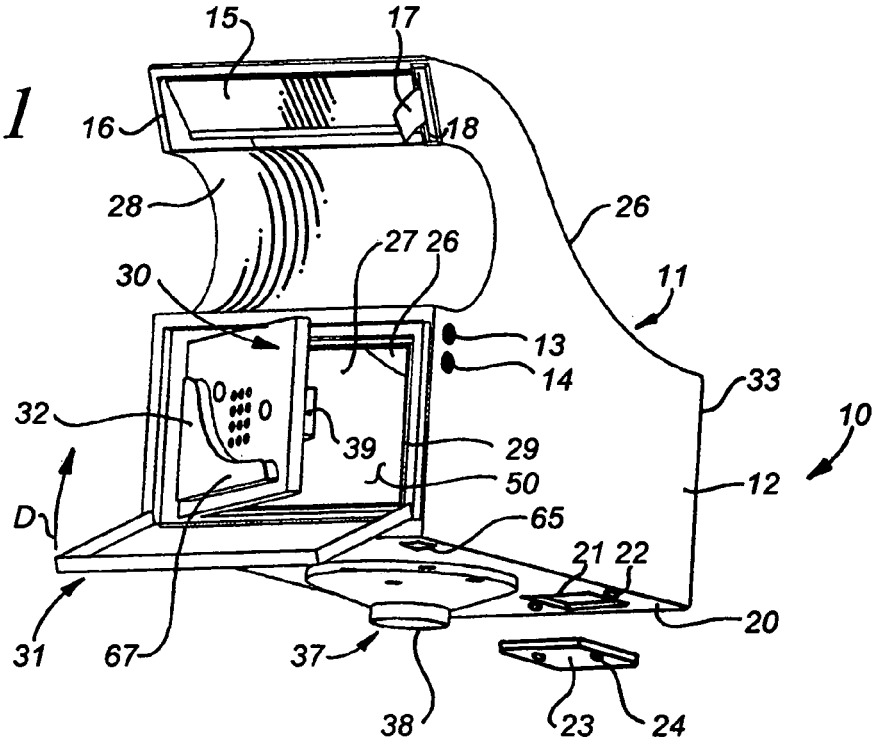
FIG. 1 is a perspective view illustrating a mailbox constructed in accordance with the principles of the invention.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a security mailbox 10 constructed in accordance with the invention and including a housing 11 having an interior 50; an arcuate top 26; a rectangular flat back 33; a pair of flat, spaced apart, opposed sides 12, 27 each having generally the same shape and dimension; a generally flat rectangular bottom 20; a corrugated floor 46 resting on top of the bottom 20; a circular retainer 37 affixed to bottom 20 and including a hollow neck 38 for receiving the upper end 51 of a support post 52; a first inner door 30; a second outer door 31; an opening 29; a mail receiving slot 16; a flap 15 for opening and closing slot 16; a handle 17 that extends through slot 18 and is fixedly attached to flap 15 to be manually moved up and down to open and close flap 15; and, an arcuate neck portion 28 extending between slot 16 and opening 29.

Figure 2:
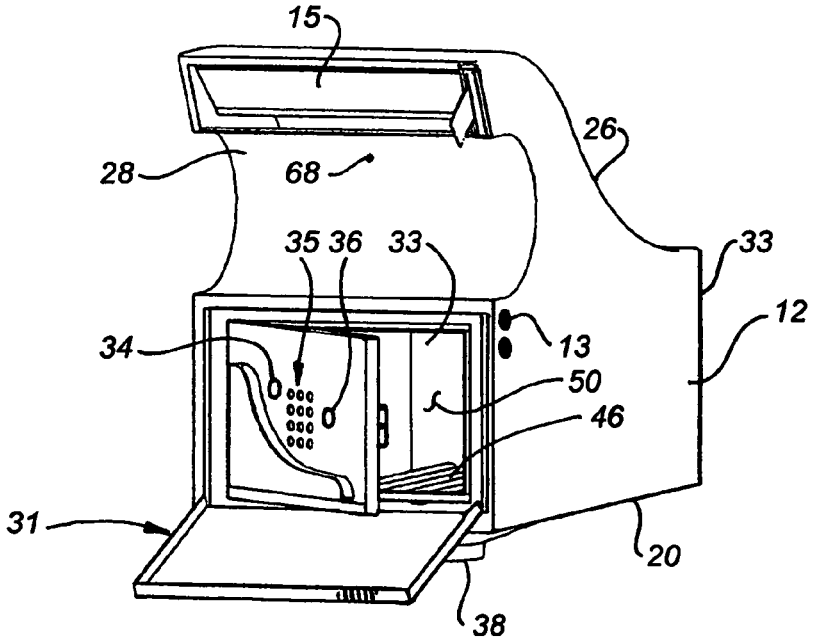
FIG. 2 is a perspective view of the mailbox of FIG. 1 further illustrating construction details thereof.

Inner door 30 has at least first and second operative positions. In the first operative position, door 30 is closed and prevents access through opening 29 into the interior 50 of housing 11. In the second operative position, door 30 is open in the manner illustrated in FIGS. 1 to 3 and permits access through opening 29 into the interior 50 of housing 11.

A latch 39 is mounted on the interior of door 30. Electronic programmable keyboard 35 includes twelve push buttons and/or touch sensitive buttons and is used to operate latch 39 to lock and unlock door 30. Latch 39 is shown in the closed or retracted position in FIGS. 1 and 4. When latch 39 is in the retracted position, door 30 can be freely opened and closed. When door 30 is closed and latch 39 is in the open or extended position, latch 39 extends behind opening 29 on the interior 50 of mailbox 10 and prevents door 30 from being opened, much like a deadbolt lock latch prevents the door to a residence from being opened when the latch is extended.

Ten of the push buttons or keys in keyboard 35 are each numbered in conventional fashion with a different digit 1, 2, 3, 4, 5, 6, 7, 8, 9, 0. The keyboard 35 can comprise a pressure sensitive "touch screen" in which a picture of a keyboard is displayed and which is operated by a user pressing against the screen over a selected "push button". One of the remaining push buttons has the picture of a lock on the key. The other remaining push button has a "*" or "#" symbol on the push button. In operation of the electronic keyboard, when door 30 is closed, the push button bearing the picture of the lock is depressed to cause microprocessor 42 to activate a solenoid (not shown) that controls latch 39 and causes latch 39 to move to the extended position. When the latch is in the extended position, door 30 is, as earlier described, locked shut and can not be opened. When door 30 is locked shut, it is opened by depressing the appropriate sequence of the push buttons 1, 2, 3, 4, 5, 6, 7, 8, 9, 0 to enter the appropriate code to cause microprocessor 42 to activate the solenoid to cause latch 39 to move from the extended to the retracted position. This sequence of push buttons can vary but typically consists of depressing from two to eight push buttons. When latch 39 is in the retracted position, door 30 can be opened.

A mail slot 32 is attached to or formed on the outside of inner door 30 to receive and store mail for pickup by a mailman. Slot 32 can also, if desired, be attached to or formed on the inside or outside of outer door 31.

The microprocessor 42 and the solenoid are powered by replaceable batteries (not visible) included in microprocessor 42. Any desired system can be used to provide power to operate microprocessor 42 and the solenoid, including by way of example and not limitation, solar power and a hard electrical line from a source in or adjacent or remote from mailbox 10.

Figure 5:
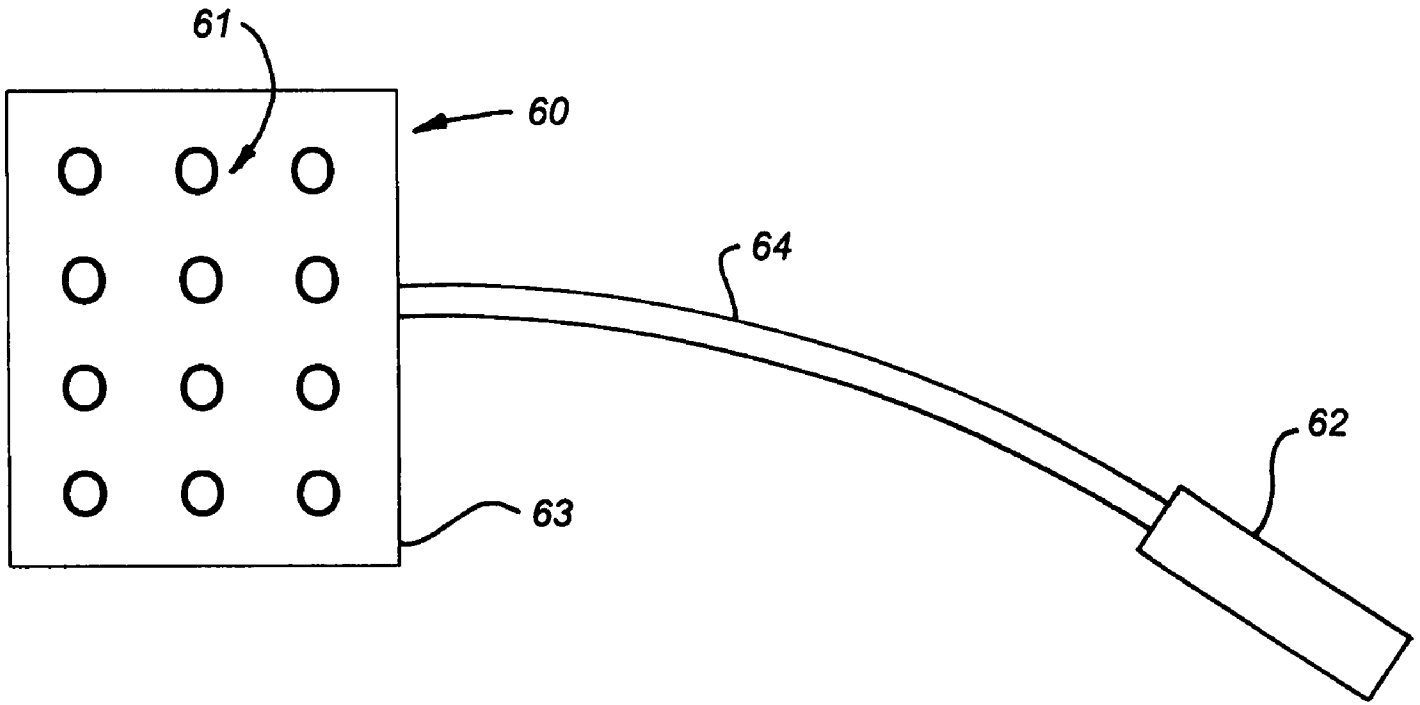
FIG. 5 is a front view of an auxiliary power system that can be used to open and to lock the mailbox of FIG. 1.

In the event the batteries providing the power to operate electronic programmable keyboard 35, lights 13 and 14, and the solenoid or other latch operation system fail, an auxiliary power system 60 is provided. System 60 is illustrated in FIG. 5 and includes a housing 63, twelve button keyboard 61 comparable to keyboard 35, a microprocessor equivalent to microprocessor 42, batteries (not shown) in housing 63 to power the microprocessor in housing 63 and to power the solenoid that operates latch 39, an electrical connector shaped to be slidably inserted in a receptacle 34 formed in door 30, and a cable 64 interconnecting housing 63 and connector 62. System 60 is utilized by inserting connector 62 in receptacle 34 and by operating keyboard 61 in the same manner earlier described with respect to keyboard 35. Accordingly, in order to open or retract latch 39, the proper access code is input by sequentially depressing the appropriate keys in keyboard 61. If, for example, the access code is "33456", then the "3" key is pressed once, is pressed again, the "4" key is depressed, the "5" key is depressed, and the "6" key is depressed. This causes latch 39 to retract. To close door 30 by extending latch 39, the key on keyboard 61 that has a lock inscribed on the top of the key is depressed. Depressing this key on the keyboard causes latch 39 to extend.

Entering a code in a keyboard 35, 61 is presently accomplished by first depressing the "*" or "#" key, as the case may be; by depressing the 1 to 0 keys in the sequence necessary to enter the desired code, and by then depressing the "*" or "#" key once again. All codes programmed in microprocessor 42 can be erased by depressing the "*" or "#" key twice and by entering another code (for example, "0001") to program microprocessor 42. Each code can include two to eight digits. Up to six different codes can be programmed in keyboard 35, 61. For example, to program in the codes "4566" and "23366678", the user depresses the "*" or "#" key, as the case may be, depresses the "4" key, the "5" key, the "6" key twice sequentially, and the "*" or "#" key. The user then depresses the "*" or "#" key, depresses the "2" key, the "3" key twice sequentially, the "6" key three times sequentially, the "7" key, the "8" key, and the "*" or "#" key. This programs both codes "4566" and "23366678" in the microprocessor 42. Consequently, if a user utilizes keyboard 35 to enter either code in microprocessor 42, microprocessor will cause latch 39 to retract and open.

Red flag 65 is pivotally attached to the bottom 20 and can be deployed by pivotally pulling flag 65 downwardly in the direction of arrow C from the orientation shown in FIG. 1 to the orientation shown in FIG. 3. Flag 65 is presently made of a ferrous material and a magnet (not shown) mounted on bottom 20 holds flag 65 in the storage position shown in FIG. 1. A releasable clip, VELCRO™ strips, or any other desired means can be utilized to secure flag 65 in the stowed position of FIG. 1. Once flag 35 is a distance from bottom 20 that is sufficient to escape the magnetic field of the magnet, flag 65 falls under gravity to the position shown in FIG. 3.

When mail is placed in outgoing slot 32, a sensor 67 (FIG. 1), another sensor, or a button (not shown) that is in the bottom of slot 32 and is contacted by mail dropped in slot 32 generates a signal to microprocessor 42. When microprocessor 42 receives the signal, it activates red light 14 and causes light 14 to flash such that when door 31 is (after door 30 is closed) upwardly pivoted to the closed position to obscure door 30 and slot 32, a postman or postwoman knows that there is mail to be picked up from slot 32. Red light is turned off by sensor 67 after the mail is removed from slot 32. Door 31 is in the open position in FIGS. 1 to 3. When sensor 67 detects that mail is removed from slot 32, sensor 67 generates a signal to microprocessor 42. When microprocessor 42 receives the signal, it turns off light 14.

Similarly, when mail is inserted through slot 16 into mailbox 10, sensor 68 (FIG. 2) or another sensor detects that mail is inserted and/or is present inside mailbox 10 and activates green light 13 such that it flashes to notify the owner of mailbox 10 that there is mail in the box 10. Once latch 39 is retracted, microprocessor 42 turns off light 13.

A fingerprint reader can be utilized with or in place of keyboard 35 to open and close latch 39. For example, one touch of the owner's fingerprint to the reader can function to close latch 39, and two sequential touches to the reader can function to open latch 39.

Housing 11 includes a compartment 21 in which an emergency round non-duplicatable key (not shown) or other key or opening mechanism is stored. The compartment 21 is covered by a plate 23 that is secured with Allen screws or other fasteners that are threadably inserted through and into aligned opening 22, 24. The round key is inserted in lock 36 (FIG. 2) and turned to open and close manually latch 39.

The microprocessor 42 includes at least one speaker 70 (FIG. 3). When latch 39 is closing the microprocessor causes a first sound to be broadcast over the speaker 70 to the individual who is operating keyboard 35 to close latch 39. When latch 39 is opening, the microprocessor 42 causes a second sound different from (or, if desired, the same as) the first sound to be broadcast over the speaker 70 to the individual who is opening latch 39 and door 30. If the latch 39 is jammed, microprocessor 42 causes a third sound different from the first and second sounds to be broadcast over the speaker 70. If the battery power is low, microprocessor 42 causes a fourth sound different from the first, second, and third sounds to be broadcast over the speaker 70.

Mailbox 70 is preferably constructed such that when door 30 is closed, there are no exposed nuts, bolts, screws, or fastener heads. This is one reason why the retainer 37 is attached to bottom 20 by welding or by inserting a fastener "inside-out" through an aperture(s) 40 into retainer 37 such that the head of the fastener is located inside housing 11.

Keypad 35 preferably glows in the dark or is lighted such that it can be readily seen in the dark.

Housing 11 preferably is constructed of solid fourteen gauge steel or of heavier steel.

The lower end 53 of post 52 is preferably embedded in concrete, but can simply be buried in the ground. Arms 54 on end 53 extends outwardly from end 53 to prevent post 52 from being rotated in the direction of arrow B. Rotating post 52 about its longitudinal axis can facilitate attempting to remove post 62 from the ground.

Slot 16 and chute 75 are shaped and dimensioned to make it impractical for an individual to attempt to stick his hand and arm through slot 16, down chute 75, and into interior 50 to grab and remove mail from interior 50. Slot 16 is sized to be too small to permit the forearm and upper arm of an average adult to fit through the slot 16, preferably is sized to prevent the wrist and forearm from fitting through slot 16, and most preferably is sized to prevent the hand of an average adult from fitting through the slot 16. Chute 75 is shaped to prevent the lower and upper arm of an average adult from fitting through chute 75, from bending around the curvature on the interior of chute 75, and/or from extending the distance from slot 16 to bottom 20, and preferably is shaped to prevent the lower and upper arm of an average adult from fitting through chute 75, bending around the curvature on the interior of chute 75, and/or extending the distance from slot 16 to door 30.

Having described my invention in such terms as to enable those of skill in the art to make and practice it, and having described the presently preferred embodiments thereof.

I claim:

1. A mailbox system including (a) an auxiliary power unit including an electrical connector;

(b) a mailbox comprising (i) a housing having an interior;

(ii) a slot in said housing for inserting mail through said slot into said interior of said housing;

(iii) a doorway in said housing to access said interior;

(iv) a door mounted in said doorway to access said interior and including a lock, said door movable between at least two operative positions, a first operative position closing said doorway and preventing access to said interior, and a second operative position opening said doorway and permitting access to said interior;

(v) a programmable electronic keypad operatively associated with said lock to move said lock between at least two operative positions, a closed position to secure said door in said first operative position, and an open position to permit said door to move from said first operative position to said second operative position;

(vi) a primary power source to provide electric power to operate said keypad; and, (vii) an access port to receive said electrical connector of said auxiliary power unit to connect said auxiliary power unit to said mailbox to operate said lock when said primary power source fails;

wherein said auxiliary power unit includes another keypad operable to move said lock between said closed position and said open position.

2. The mailbox system of claim 1 wherein said auxiliary power unit includes a microprocessor.

3. A mailbox comprising (a) a housing having an interior mail delivery compartment;

(b) a slot in said housing for inserting mail through said slot into said interior mail delivery compartment of said housing;

(c) a doorway in said housing to access said interior;

(d) a door mounted in said doorway to access said interior and including a lock, said door movable between at least two operative positions, (i) a first operative position closing said doorway and preventing access to said interior, and (ii) a second operative position opening said doorway and permitting access to said interior;

(e) a programmable electronic keypad operatively associated with said lock to move said lock between at least two operative positions, (i) a closed position to secure said door in said first operative position, and (ii) an open position to permit said door to move from said first operative position to said second operative position;

(fi) a primary power source to provide electric power to operate said keypad;

(g) a mail pickup compartment (32) separate from said mail delivery compartment;

(h) a first sensor (68) to detect when mail has been placed through said slot into said mail delivery compartment; and, (i) a second sensor (67) to detect when mail has been placed in said mail pickup compartment.

4. The mailbox of claim 3 including a light (13) operably associated with said first sensor and activated when said first sensor detects mail placed through said slot into said mail delivery compartment.

5. The mailbox of claim 4 including a second light (14) operably associated with said second sensor and activated when said second sensor detects mail in said mail pickup compartment.

6. A mailbox comprising (a) a housing including (i) an interior mail delivery compartment having a bottom, and (ii) having an interior curvature;

(b) a slot in said housing for inserting mail through said slot into said interior mail delivery compartment of said housing;

(c) a doorway in said housing to access said interior;

(d) a door mounted in said doorway to access said interior and including a lock, said door movable between at least two operative positions, (i) a first operative position closing said doorway and preventing access to said interior, and (ii) a second operative position opening said doorway and permitting access to said interior;

(e) a programmable electronic keypad operatively associated with said lock to move said lock between at least two operative positions, (i) a closed position to secure said door in said first operative position, and (ii) an open position to permit said door to move from said first operative position to said second operative position;

(fi) a primary power source to provide electric power to operate said keypad;

(g) an emergency round key;

(h) a system to manually open and close said lock, said system including an opening shaped and dimensioned to receive said emergency key to manually open and close said lock; and, (i) a covered compartment (21) in said mailbox in which to store said in said mailbox in which to store said emergency key.

7. The mailbox of claim 6 wherein (a) said slot is shaped and dimensioned to prevent the forearm and upper arm of an average sized adult from fitting through slot 16; and, (b) said chute is shaped and dimensioned to prevent the lower and upper arm of an average sized adult from fitting through chute 75, from bending around said interior curvature of said chute 75, and from extending the distance from said slot to said bottom.

8. The mailbox system of claim 1 wherein said access port is on said door.

9. The mailbox system of claim 8 wherein said keypad is on said door.

10. The mailbox system of claim 1 wherein said electrical connector slides into said access port.

11. The mailbox of claim 3 wherein said mail pickup compartment is on said door.

12. The mailbox of claim 3 including a second door (31) and said mail pickup compartment is on said second door.

* * * * *